US006070032A

United States Patent [19]

Rokutanda et al.

[11] Patent Number: 6,070,032

[45] Date of Patent: May 30, 2000

[54] ELECTROSTATIC PRINTING APPARATUS HAVING AN ERASE LAMP

[75] Inventors: Takashi Rokutanda, Hitachinaka; Takao Umeda, Mito; Yukio Otome, Tokai-mura, all of Japan

[73] Assignee: Hitachi Koki Co., Ltd., Tokyo, Japan

[21] Appl. No.: 09/323,842

[22] Filed: Jun. 2, 1999

[30] Foreign Application Priority Data

Jun. 2, 1998 [JP] Japan ..... 10-153102

[51] Int. Cl.[7] ..... G03G 15/04; G03G 21/00

[52] U.S. Cl. ..... 399/128; 399/51; 430/902

[58] Field of Search ..... 399/127, 128, 399/38, 46, 51, 129; 430/902

[56] References Cited

U.S. PATENT DOCUMENTS

| | | | |
|---|---|---|---|
| 4,474,455 | 10/1984 | Hirakura et al. | 399/128 |
| 4,538,900 | 9/1985 | Lutus et al. | 399/128 |
| 4,827,306 | 5/1989 | Tsujimoto et al. | 399/128 |
| 5,534,980 | 7/1996 | Tanaka | 399/168 |
| 5,701,560 | 12/1997 | Tsujita et al. | 399/128 X |
| 5,737,663 | 4/1998 | Handa et al. | 399/51 X |
| 5,771,422 | 6/1998 | Morihara | 399/46 X |
| 5,850,585 | 12/1998 | Tsutsumi et al. | 399/128 |

FOREIGN PATENT DOCUMENTS 57-004064 1/1982 Japan .

*Primary Examiner*—Sophia S. Chen

*Attorney, Agent, or Firm*—Antonelli, Terry, Stout & Kraus, LLP

[57] ABSTRACT

In an electrostatic printing apparatus, the residual image phenomenon conspicuously observed at low density printing can be eliminated while photo-deterioration of the photosensitive body is being suppressed to a minimum in a high speed printing process. A charging unit, a writing light source, a developing unit, a transfer unit, a first erase lamp, an AC discharging unit and a second erase lamp are arranged around a photosensitive drum. Therein, the light intensity of the erase lamp is strengthened when the density of a printed image is light and is weakened when the density of the printed image is dark. That is, by changing the light intensity of the erase lamps corresponding to a developing bias, the residual image phenomenon can be eliminated while suppressing deterioration of the photosensitive drum to a minimum.

7 Claims, 6 Drawing Sheets

ELECTROSTATIC PRINTING APPARATUS HAVING AN ERASE LAMP

BACKGROUND OF THE INVENTION

The present invention relates to an electrostatic printing apparatus (an electrophotographic apparatus) utilizing an electrophotographic method, such as a copier, a printer and the like; and, more particularly, the invention relates to control of an erasing unit for removing residual charge on a photosensitive body using an erasing light.

An electrostatic printing apparatus utilizing an electrophotographic method has a construction in which various kinds of electrophotographic processing units, such as a charging unit, a light writing unit (an exposing device), a developing unit, a transferring unit, a separating unit, a cleaning unit, a discharging unit and so on, are serially arranged around a photosensitive body, and the charged photosensitive body is exposed based on image information to form an electrostatic latent image on the surface of the photosensitive body, and the latent image is converted to a visible image using toner.

A line printer provided as an electrostatic printing apparatus is required to have a printing speed which is higher with an increase of the information volume to be processed. In high speed printing, abrasion of the photosensitive body becomes large due to friction with the paper and the developer. In order to avoid such a large abrasion, an $As_2Se_3$ group photosensitive body (Vickers hardness: Hv≈150) has been widely used.

The $As_2Se_3$ photosensitive body has a less stable residual electric potential compared to a Selenium Tellurium alloy photosensitive body. Therefore, when the same pattern is repetitively printed, the residual electric potential at that portion is increased. Then, when a pattern covering over both the portion having an increased electric potential and a portion unit having an increased electric potential is printed, a light portion and a dark portion appear in the image.

For example, when a whole black image is printed after thin lines are repetitively printed, there appears a phenomenon that the whole black image is bleached out in the portions corresponding to the thin lines which were repetitively printed just before. That is, a so-called residual image phenomenon takes place (refer to white bleached out portion in FIG. 2). The residual image phenomenon is conspicuously observed when an image having a low density is printed.

As a solution to the problem of the residual image phenomenon, it has been proposed to add iodine to an $As_2Se_3$ photosensitive body or to thin the film thickness of the photosensitive body. However, in a high speed printing machine, even if the addition of iodine or the thinning of the film thickness of the photosensitive body is performed, light and dark portions are produced in a image due to an increase of the residual electric potential at the time of low density printing. The portions exhibiting a residual image phenomenon can be made less conspicuous by increasing the light intensity of the erasing light, but this approach is not preferable because the lifetime of the photosensitive body is shortened when a large amount of light is always irradiated thereon.

SUMMARY OF THE INVENTION

An object of the present invention is to provide an electrostatic printing apparatus in which the residual image phenomenon conspicuously observed at low density printing is eliminated, while photo-deterioration of the photosensitive body is suppressed to a minimum in a high speed printing process.

In order to attain the above object, a first aspect of the present invention is characterized by an electrostatic printing apparatus having a charging unit, a writing unit, a developing unit, a transfer unit, a cleaning unit and an AC discharging unit disposed around a photosensitive body; and an erasing unit for removing residual charge on the photosensitive body using erasing light, the erasing unit being located at a position between the transfer unit and the AC discharging unit or a position between the AC discharging unit and the charging unit. Exposure is performed on the charged photosensitive body based on image information to form an electrostatic latent image on a surface of the photosensitive body, the latent image being converted to a visible image using toner. In accordance with the present invention, the light intensity of the erasing light of the erasing unit is controlled so as to be strengthened when the density of the printed image is light and weakened when the density of the printed image is dark.

Further, in order to attain the above object, a second aspect of the invention is characterized by the above-mentioned electrostatic printing apparatus, wherein the light intensity of the erasing light is strengthened as the developing bias voltage is decreased in a case of the reversal development.

Further, in order to attain the above object, a third aspect of the present invention is characterized by the above-mentioned electrostatic printing apparatus, wherein the light intensity of the erasing light is strengthened as the developing bias voltage is increased in a case of a normal development.

Further, in order to attain the above object, a fourth aspect of the present invention is characterized by the above-mentioned electrostatic printing apparatus, wherein the erasing means comprises an LED lamp, and the light intensity of the erasing light is controlled by changing the current applied to the LED lamp.

Further, in order to attain the above object, a fifth aspect of the present invention is characterized by the above-mentioned electrostatic printing apparatus, wherein the erasing means comprises a fluorescent lamp, and the light intensity of the erasing light is controlled by switching the fluorescent lamp on and off.

Further, in order to attain the above object, a sixth aspect of the present invention is characterized by the above-mentioned electrostatic printing apparatus, wherein the photosensitive body is made of a selenium arsenic alloy ($As_2Se_3$) photosensitive material.

Further, in order to attain the above object, a seventh aspect of the present invention is characterized by the above-mentioned electrostatic printing apparatus, wherein the wavelength of the erasing light is longer than the wavelength of the writing light.

DESCRIPTION OF THE PREFERRED EMBODIMENTS

As described above, the present invention can provide an electrostatic printing apparatus in which photo-deterioration of the photosensitive body can be suppressed, the residual image phenomenon observed conspicuously at low density printing can be eliminated, and high quality printing with low fog density in the background in a high speed printing process of, for example, 500 mm/sec to 1,500 mm/sec can be performed, by controlling the light intensity of the erasing light of the erasing unit so that the light intensity is strengthened when the density of the printed image is light and weakened when the density of the printed image is dark.

Figure 1:
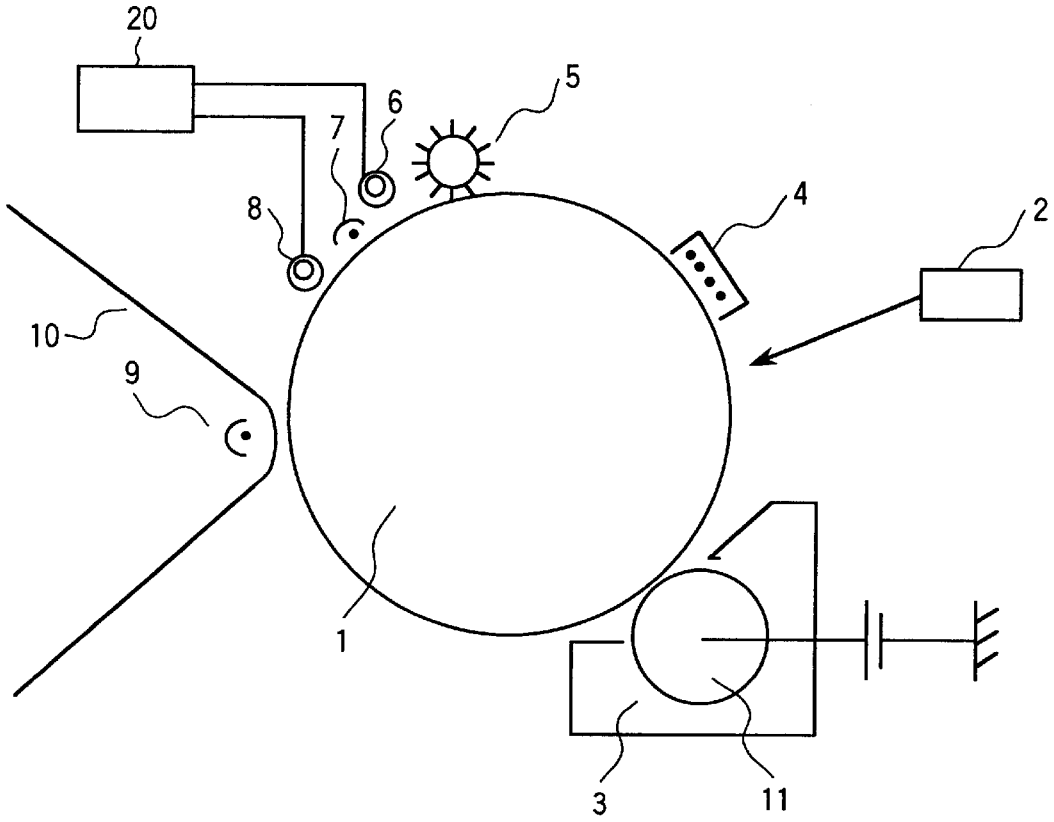
FIG. 1 is a diagrammatic view showing the construction of an image forming system representing an embodiment of an electrostatic printing apparatus in accordance with the present invention.
Figure 2:
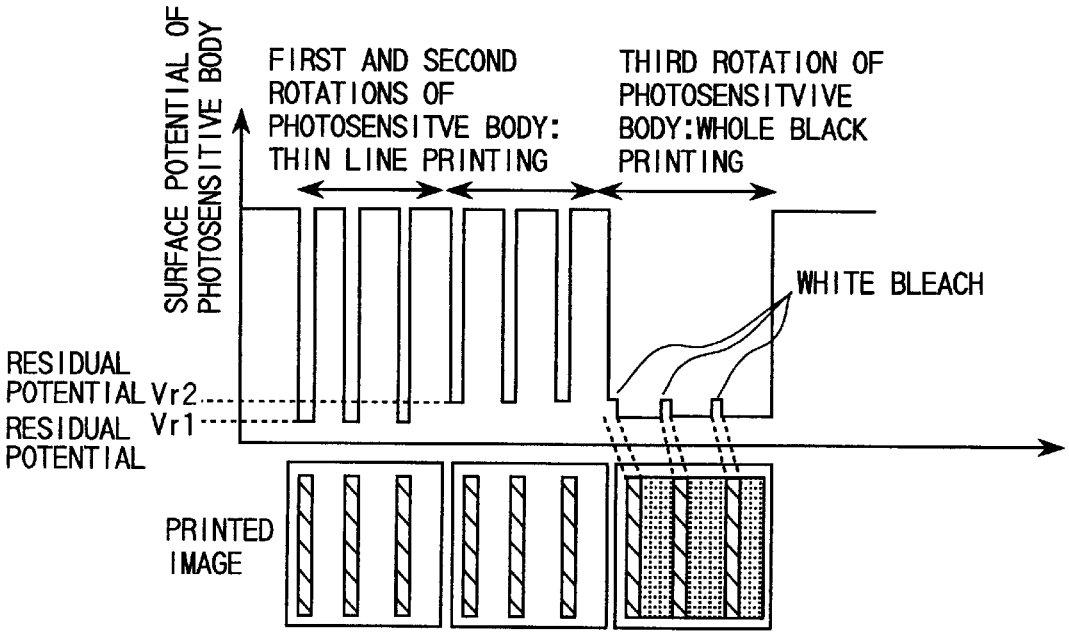
FIG. 2 is a diagram showing a change in surface potential of a photosensitive body when a residual image phenomenon is produced and images are printed at that time.

An embodiment of the present invention will be described below with reference to the drawings. FIG. 1 is a view showing the construction of an image forming system in an electrostatic printing apparatus. In the figure, the reference character 1 indicates a photosensitive drum having a diameter of 150 mm to 300 mm used as an image holding body, which photosensitive drum is rotated at a peripheral speed (processing speed) of approximately 500 mm/sec to 1,500 mm/sec. Process components necessary for forming images, such as a writing light source 2, a developing unit 3, a charging unit 4, a cleaning unit 5, a first erase lamp 6, an AC discharging unit 7, a second erase lamp 8, and a transfer unit 9, are arranged around the photosensitive drum 1. The reference character 10 indicates a paper sheet to which a toner image on the photosensitive drum 1 is transferred, and the reference character 11 indicates a developing roller installed in the developing unit 3.

Embodiment 1

In the electrostatic printing apparatus shown in FIG. 1, A semiconductor laser of the InGaAIP/GaAs group (wavelength of 640 nm) is used as the writing light source 2, and the light intensity for exposure is set to approximately 12 mW/cm$^2$ on the surface of the photosensitive drum 1. A photosensitive body film (film thickness of 45 $\mu$m) made of di-arsenic tri-selenide ($As_2Se_3$) having a good rubbing resistance and sensitivity to a long wavelength light is used in the photosensitive drum (262 mm outer diameter, 430 mm length). Its peripheral speed is set to approximately 825.5 mm/sec.

Image forming in accordance with the present invention is performed as follows. Here, the description will be directed to a case of reversal development. Initially, the surface of the photosensitive drum 1 is charged to a surface electric potential of approximately +500 V using the charging unit 4. Next, image exposure (writing using a laser beam modulated corresponding to an image signal) is performed by the writing light source 2 to form an electrostatic latent image on the photosensitive drum 1, and the latent image is converted to a visible image using the developing unit 3. Therein, a voltage of +100 V is applied to the developing roller 11 of the developing unit 3. The toner image visualized by the developing unit 3 is transferred to the paper sheet 10 using the transfer unit 9.

After that, any residual charge on the photosensitive drum 1 is discharged using the AC discharging unit 7, the first erase lamp 6 (red light of 630 nm wavelength) and the second erase lamp 8 (blue light of 450 nm wavelength). Then, the surface of the photosensitive drum 1 is cleaned by the cleaning unit 5 (a fur brush made of polyamide resin was used in the present embodiment) to prepare the drum for the next image forming process.

In the electro-photographic process described above, the occurrence of the residual image phenomenon was checked by printing a whole black image after printing thin line images with varying light intensity of the first erase lamp 6 (red light of 630 nm wavelength).

Figure 3:
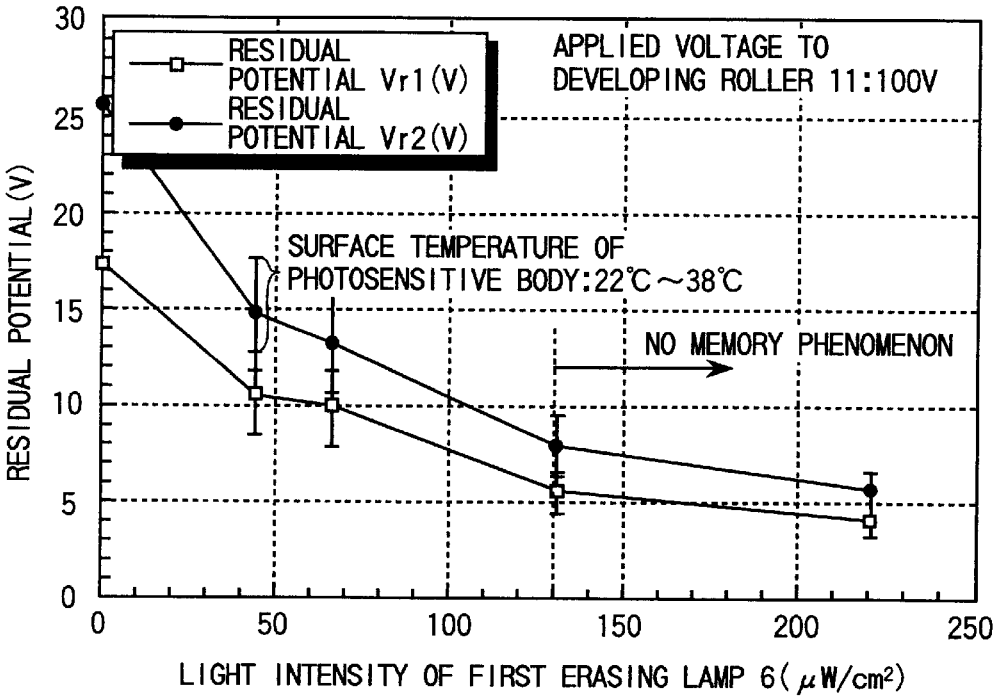
FIG. 3 is a characteristic diagram showing the relationship between light intensity of the first erase lamp and residual electric potential of the photosensitive body when the voltage applied to the developing roller is 100 V.

FIG. 3 is a characteristic diagram showing the relationship between the light intensity of the first erase lamp 6 and the residual electric potentials Vr1, Vr2 when an applied voltage to the developing roller 11 is 100 V, and each of the residual electric potential values Vr1, Vr2 when the surface temperature of the photosensitive body 1 differs (22° to 38°) is shown by an average value and an upper limit value and a lower limit value.

It is clear from FIG. 3 that the residual electric potentials Vr1, Vr2 and the difference between them $\Delta$Vr (>0) decreases with an increase of the light intensity of the first erase lamp 6, and the residual image phenomenon disappears at a surface temperature of the photosensitive drum 1 of 28° C. when the light intensity of the first erase lamp 6 becomes approximately 1.6 $\mu$J/cm$^2$ even though the applied voltage to the developing roller 11 is 100 V.

However, it was found that the fog density was increased as a result of deterioration of the photosensitive characteristics, such as a decrease in the charging capability, deterioration in the dark decay characteristic and so on, during continuous printing due to photo-fatigue when such a high power as 130 $\mu$W/cm$^2$ was always used. Further, there occurred a problem that the lifetime of the photosensitive body was also shortened.

Figure 4:
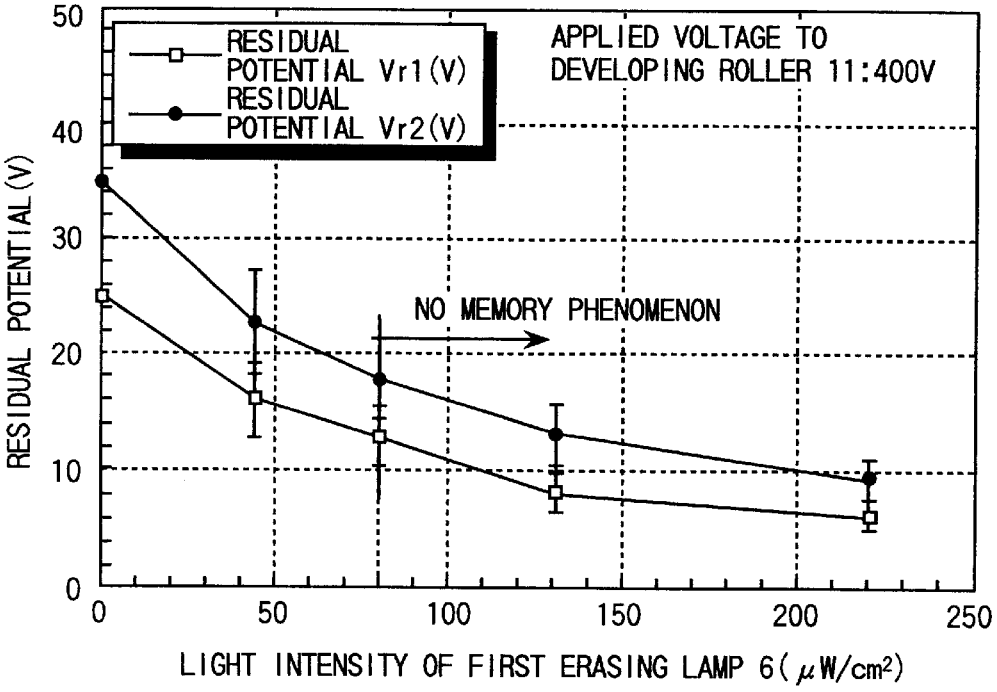
FIG. 4 is a characteristic diagram showing the relationship between light intensity of the first erase lamp and residual electric potential of the photosensitive body when the voltage applied to the developing roller is 400 V.
Figure 5:
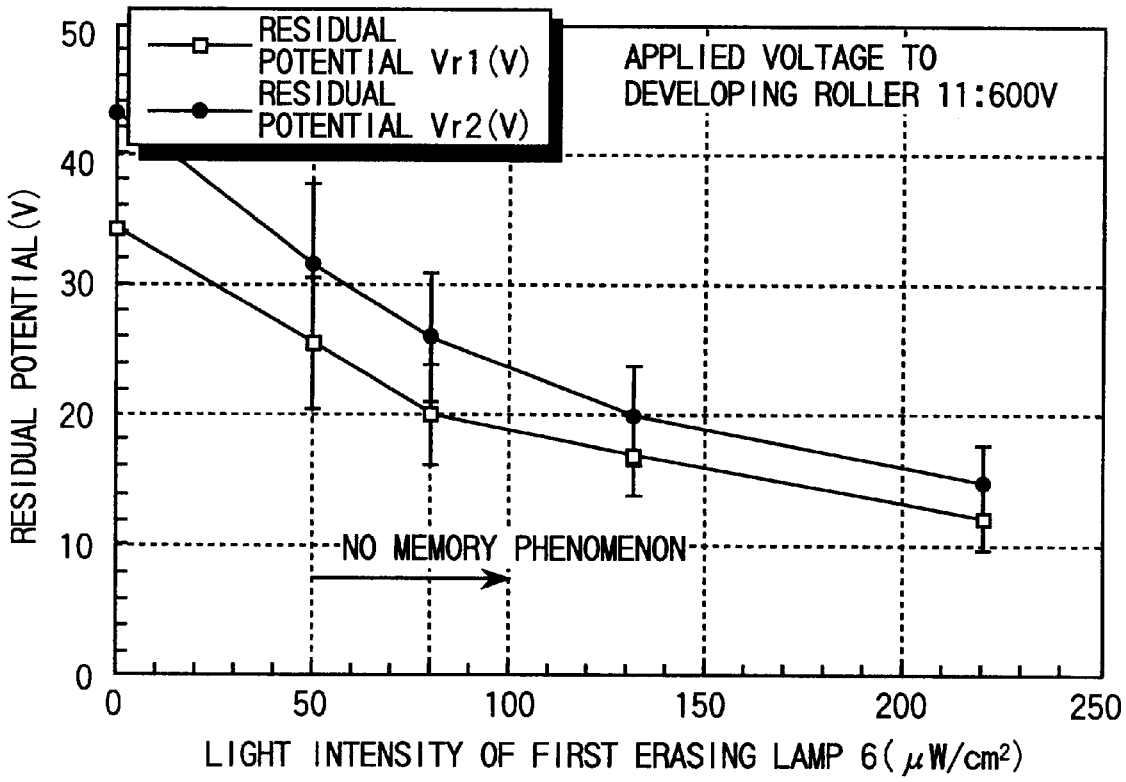
FIG. 5 is a characteristic diagram showing the relationship between light intensity of the first erase lamp and residual electric potential of the photosensitive body when the voltage applied to the developing roller is 600 V.

Therefore, in accordance with the present invention, the light intensity of the first erase lamp 6 is controlled by a signal from a light intensity controller 20 to reduce the light intensity during high density printing in which the residual image phenomenon hardly occurs. FIG. 4 and FIG. 5 are characteristic diagrams showing the relationship between the light intensity of the first erase lamp 6 and the residual electric potentials Vr1, Vr2 when the applied voltages to the developing roller 11 are 400 V, 600 V, respectively.

It is clear from FIG. 4 that no residual image phenomenon is observed and printed matter can be obtained without disturbing the image quality when the light intensity of the first erase lamp 6 is above approximately 80 $\mu$W/cm$^2$ for an applied voltage to the developing roller 11 of 400 V, and it is clear from FIG. 5 that no residual image phenomenon is observed when the light intensity of the first erase lamp 6 is above approximately 50 $\mu$W/cm$^2$ for an applied voltage to the developing roller 11 of 600 V.

From the above, it can be seen that, by varying the light intensity of the erase lamp corresponding to the developing bias value, it is possible to suppress the residual image phenomenon without disturbing the image quality, to lengthen the lifetime of the photosensitive body by decreasing the deterioration thereof and to stably obtain high quality images.

Figure 9:
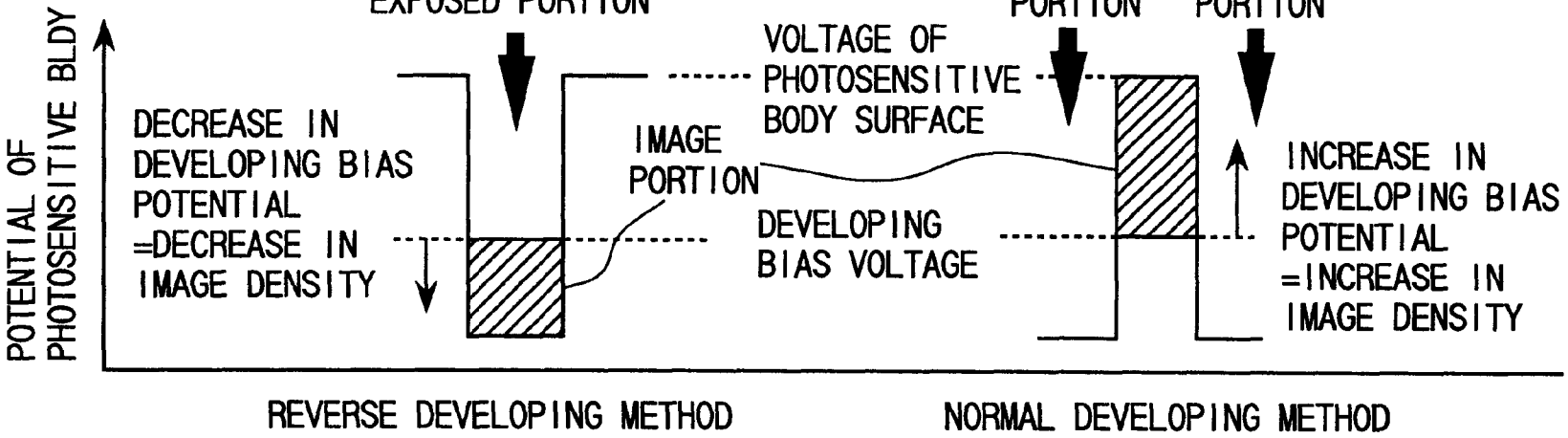
FIG. 9 is a diagram illustrating the relationship between developing bias voltage and image density for each developing method.

FIG. 9 is a diagram illustrating the relationship between developing bias voltage and image density for each developing method. As shown in this figure, in the case of the reverse developing method, the image density becomes light when the developing bias voltage is decreased. On the other hand, in the case of the normal developing method, the image density becomes light when the developing bias voltage is increased.

Therefore, in the case of the reverse developing method shown in FIG. 3 to FIG. 5, the residual image phenomenon can be suppressed by controlling the erase lamp so as to strengthen the light intensity of the erase lamp when the image density is light as a result of a decrease in the developing bias voltage. On the other hand, in the case of the normal developing method, the residual image phenomenon can be suppressed by controlling the erase lamp so as to strengthen the light intensity of the erase lamp when the image density is light as a result of an increase in the developing bias voltage.

Therein, in a case of using an LED lamp as the erase lamp, the light intensity of the erase lamp can be controlled by varying the current supplied to the LED lamp. In a case of using a plurality of fluorescent lamps as the erase lamp, the light intensity of the erase lamp can be controlled by on/off control of the fluorescent lamps.

Embodiment 2

Figure 6:
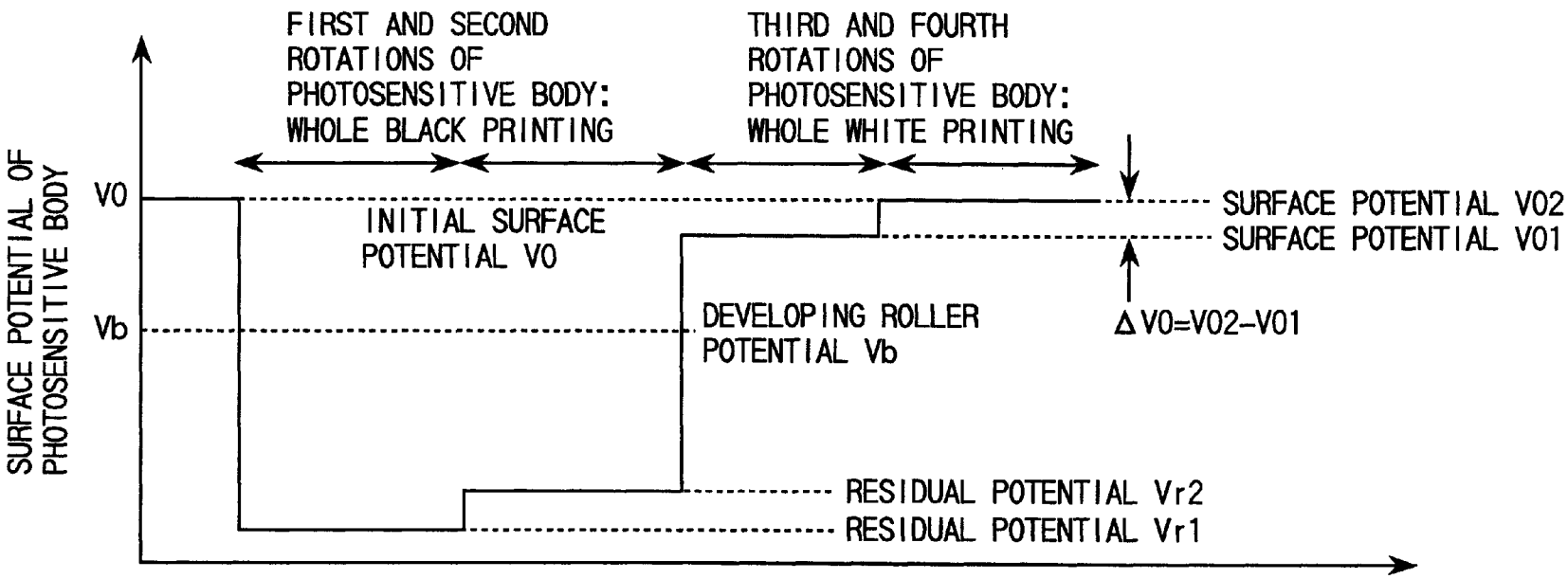
FIG. 6 is a diagram showing a change in surface electric potential when the fog density is increased.

Since the mobility of the $As_2Se_3$ photosensitive body is small, the photosensitive body proceeds to the next process (exposing process, developing process or the like) before the surface electric potential reaches a value that it should reach unless discharge is sufficiently performed. For example, whole white printing is performed by setting the surface electric potential V01 to 900 V and the developing roller electric potential Vb to 600 V after several pages of black printing is performed over the whole surface. The surface electric potential V01 for the first white paper sheet should be returned to 900 V, but it returns to only 850 V (refer to FIG. 6). In this case, the contrast electric potential (=surface electric potential−developing roller electric potential) becomes 250 V, which causes fog density. As a result of various studies, it was confirmed that the fog density was increased when V02−V01>25 (V).

Figure 7:
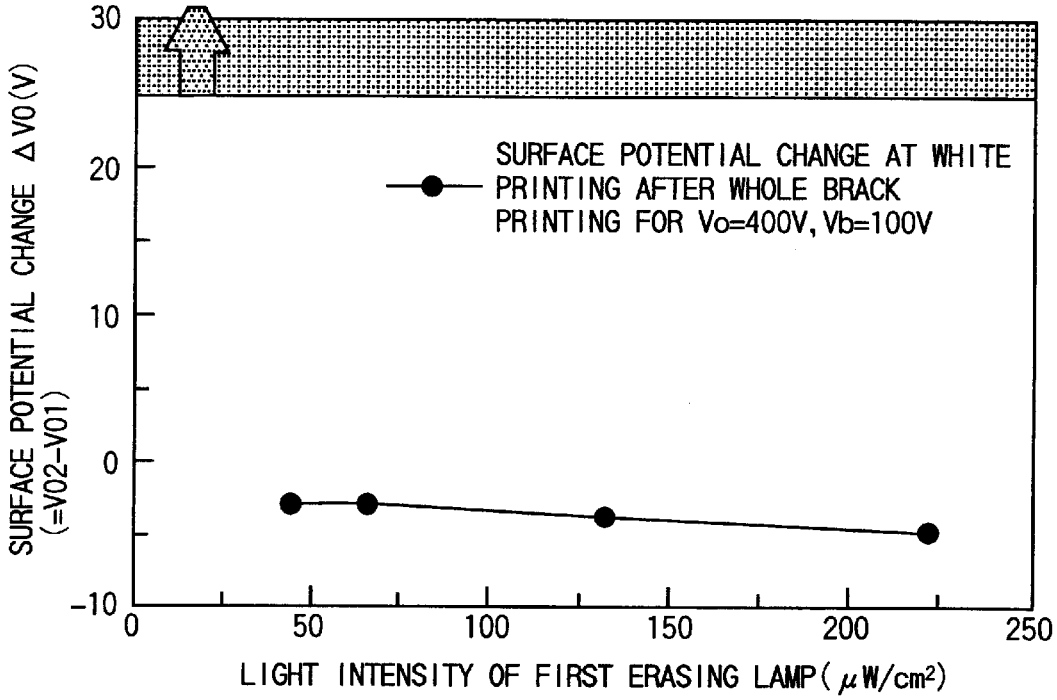
FIG. 7 is a characteristic diagram showing the relationship between light intensity of the first erase lamp and residual electric potential change of the photosensitive body.

FIG. 7 is a characteristic diagram showing a test result of surface electric potential change ΔV0 (=V02−V01) of the photosensitive body when the light intensity of the first erase lamp is varied. The surface electric potential change in this test was within +25 V, and the fog density was not observed. By conducting a similar test under conditions wherein the surface temperature of the photosensitive body was within a range of 22° C. to 38° C. and the electric potential of the developing roller was within a range of 100 V to 600 V, it was confirmed that the surface electric potential of the photosensitive body could be suppressed to such a degree as to not cause fog density when the light intensity of the first erase lamp was 50 $\mu W/cm^2$ to 250 $\mu W/cm^2$.

Embodiment 3

Figure 8:
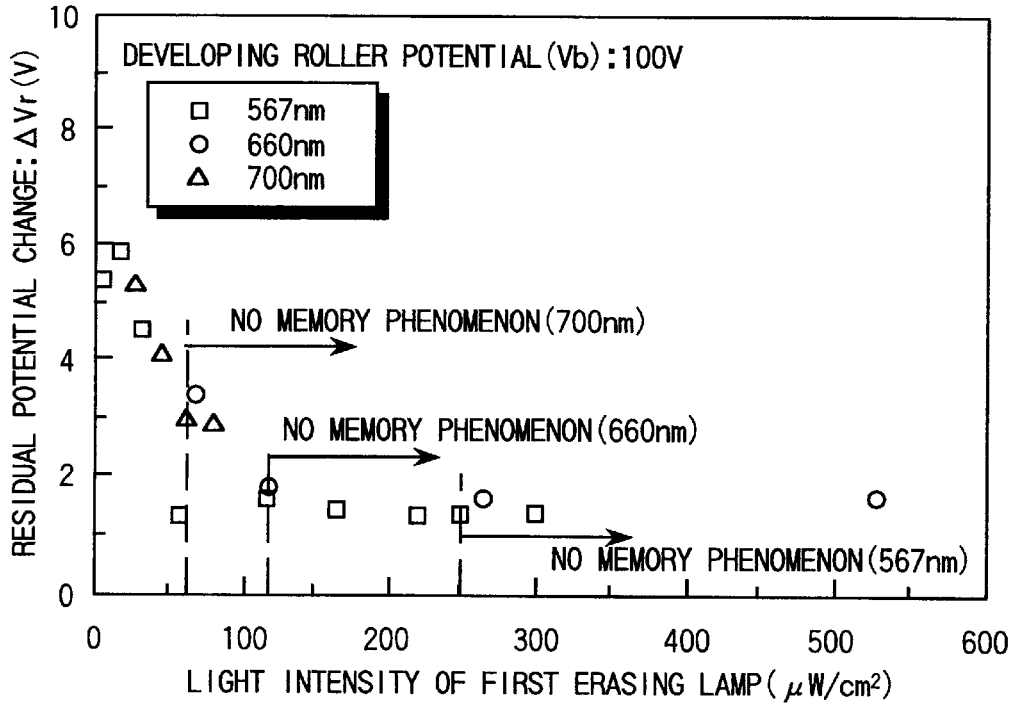
FIG. 8 is a characteristic diagram showing the relationship between light intensity of the first erase lamp and residual electric potential change of the photosensitive body for each wavelength of the first erase lamp.

The relationship among the light intensity of the first erase lamp, the residual electric potential and the surface electric potential was studied by changing the wavelength of the first erase lamp from 630 nm to 567 nm, 660 nm, 700 nm. FIG. 8 is a characteristic diagram showing the relationship between the light intensity of the first erase lamp and the residual electric potential change ΔVr when the bias voltage of the developing roller is 100 V.

It is clear from the figure that the light intensity of the erase lamp capable of suppressing the residual image phenomenon differs depending on the wavelength of the erase lamp. It can be understood that the residual image phenomenon is sufficiently suppressed with a low light intensity during high density printing similar to the case of a wavelength of 630 nm, and the residual image phenomenon can be suppressed by controlling the light intensity independently of the wavelength of the erase lamp. Particularly, by using erasing light having a wavelength longer (for example, 660 nm or 700 nm wavelength) than the wavelength (for example, 640 nm wavelength) of the writing light, the residual image phenomenon can be suppressed by a low intensity of the erase lamp from low density printing to high density printing.

Although the light intensity of the first erase lamp is controlled in the above-mentioned embodiments, the present invention is not limited to this method. In this regard, it is possible to control the light intensity of the second erase lamp or the light intensity of the first and the second erase lamps by the signal from the light intensity controller 20.

As described above, in the case of using the electrostatic printing apparatus of the present embodiment, the residual image phenomenon does not occur at low density printing, and high quality printing having a low fog density density in the background can be performed.

As described above, the present invention can provide an electrostatic printing apparatus which is capable of suppressing photo-deterioration of the photosensitive body to a minimum, of eliminating the residual image phenomenon conspicuously observed at low density printing and of performing high quality printing with low fog density in the background in a high speed printing process by controlling the light intensity of the erasing means so as to strengthen the light intensity when the density of the printed image is light and to weaken it when the density of the printed image is dark.

What is claimed is:

1. An electrostatic printing apparatus comprising a charging unit, a writing unit, a developing unit, a transfer unit, a cleaning unit, and an AC discharging unit disposed around a photosensitive body; an erasing unit for removing residual charge on the photosensitive body by use of erasing light, the erasing unit being located at any one of a position between the transfer unit and the AC discharging unit and a position between the AC discharging unit and the charging unit, whereby exposure is performed on the charged photosensitive body based on image information to form an electrostatic latent image on a surface of the photosensitive body, the latent image being converted to a visible image using toner; and means for controlling light intensity of the erasing light of said erasing unit so that the light intensity is strengthened when a density of a printed image is light and weakened when the density of the printed image is dark.

2. An electrostatic printing apparatus according to claim 1, wherein the light intensity of said erasing light is strengthened as a developing bias voltage is decreased in a case of a reversal development.

3. An electrostatic printing apparatus according to claim 1, wherein the light intensity of said erasing light is strengthened as a developing bias voltage is increased in a case of a normal development.

4. An electrostatic printing apparatus according to claim 1, wherein said erasing unit comprises an LED lamp, and the light intensity of the erasing light is controlled by changing a current applied to said LED lamp.

5. An electrostatic printing apparatus according to claim 1, wherein said erasing unit comprises a fluorescent lamp, and the light intensity of the erasing light is controlled by switching said fluorescent lamp on and off.

6. An electrostatic printing apparatus according to claim 1, wherein said photosensitive body is made of an arsenic tri-selenide group photosensitive material.

7. An electrostatic printing apparatus according to claim 1, wherein the wavelength of said erasing light is longer than the wavelength of writing light.

* * * * *